United States Patent [19]

Kawarabashi et al.

[11] Patent Number: 4,848,077

[45] Date of Patent: Jul. 18, 1989

[54] PACKAGE FEEDING METHOD AND APPARATUS

[75] Inventors: Tsukasa Kawarabashi; Shoichi Tone, both of Kyoto; Hiroo Otoshima, Shiga, all of Japan

[73] Assignee: Murata Kikai Kabushiki Kaisha, Kyoto, Japan

[21] Appl. No.: 177,628

[22] Filed: Apr. 5, 1988

[30] Foreign Application Priority Data

| | | | |
|---|---|---|---|
| Apr. 7, 1987 | [JP] | Japan | 62-85092 |
| May 27, 1987 | [JP] | Japan | 62-130092 |
| Jul. 21, 1987 | [JP] | Japan | 62-181941 |

[51] Int. Cl.[4] ..... B65H 59/34; D01H 9/18

[52] U.S. Cl. ..... 57/281; 57/269; 57/278; 242/35.6 E

[58] Field of Search ..... 57/266, 267, 268, 269, 57/270, 276–278, 281, 7, 58, 52; 242/35.6 E

[56] References Cited

U.S. PATENT DOCUMENTS

| | | | |
|---|---|---|---|
| 3,316,698 | 5/1967 | Franzen | 57/270 X |
| 3,370,412 | 2/1968 | Franzen et al. | 57/270 |
| 3,429,113 | 2/1969 | Nimtz et al. | 57/281 |
| 3,669,373 | 6/1972 | Hori et al. | 57/303 X |
| 4,583,358 | 4/1986 | Krieger et al. | 57/281 |
| 4,606,509 | 8/1986 | Hiroaki | 242/35.6 E |

*Primary Examiner*—Donald Watkins

*Attorney, Agent, or Firm*—Spensley Horn Jubas & Lubitz

[57] ABSTRACT

A package feeding method and apparatus for a yarn twisting machine having a large number of two-for-one twisters of two stage yarn supply type. A package is fed after an end of yarn of the package has been wrapped in several turns of a yarn layer non-existing portion of the package.

27 Claims, 6 Drawing Sheets

PACKAGE FEEDING METHOD AND APPARATUS

FIELD OF THE INVENTION

This invention relates to a method of feeding a yarn supply package and an apparatus for feeding a package.

RELATED ART STATEMENT

Conventionally, a means for feeding a yarn supply package mentioned above is known wherein, for example, a yarn supply package is placed on a transport medium in the form of a disk being fed on a conveyor and is transported together with the transport medium.

In such a conventional feeding means as described above, or also in some other feeding means, there is the possibility that an end of yarn of a package may get loose and afloat from a layer of the yarn during feeding of the package and may be wrapped around some member around the yarn supply package or yarn may be released from one after another of yarn supply packages during feeding.

A machine is called two-for-one twister of the two stage yarn supply type wherein packages are placed in two stages and yarns are extracted from both of the upper and lower yarn supply packages and are passed at the same time through a spindle to apply a twist to the yarns while doubling the yarns in order to supply yarn to the two-for-one twister. Since twisting is performed while doubling is performed, a conventional yarn doubling step can be eliminated, and there is a merit in reduction of labor and rationalization.

However, in a two-for-one twister of the two stage yarn supply type described above, a very large number of steps is required for an operation for exchanging a yarn supply package for a new yarn supply package when the yarn remaining on the former yarn supply package is reduced to zero. In particular, the number of steps (labor) for such exchanging reaches twice comparing simply with that where a single yarn supply package is involved.

OBJECT AND SUMMARY OF THE INVENTION

It is an object of the present invention is to provide a method and an apparatus for feeding a package without a floating yarn from a yarn layer of the package and for supplying and exchanging packages readily.

In an embodiment of the present invention, a package is fed after an end of yarn of the package has been wrapped in several turns on a yarn layer non-existing portion at the top end of the package.

Such floating yarn as described above is completely eliminated by wrapping an end of yarn of a package around the yarn layer non-existing portion as described hereinabove.

In a two-for-one twister, packages are carried by a feeding device which comprises a transport medium having a projected portion at a central portion of a plate-formed member and adapted to be fed on a conveyor, and a guide pipe in the form of a pipe adapted to be inserted into the projected portion of the transport medium, whereby a plurality of yarn supply packages are mounted on the guide pipe and fed to a two-for-one twister.

Yarn supply packages are set in a two stage series condition on the guide pipe and transported to the two-for-one twister, and they are supplied to the two-for-one twister while they are held in the set condition.

DETAILED DESCRIPTION OF PREFERRED EMBODIMENTS

Figure 8:
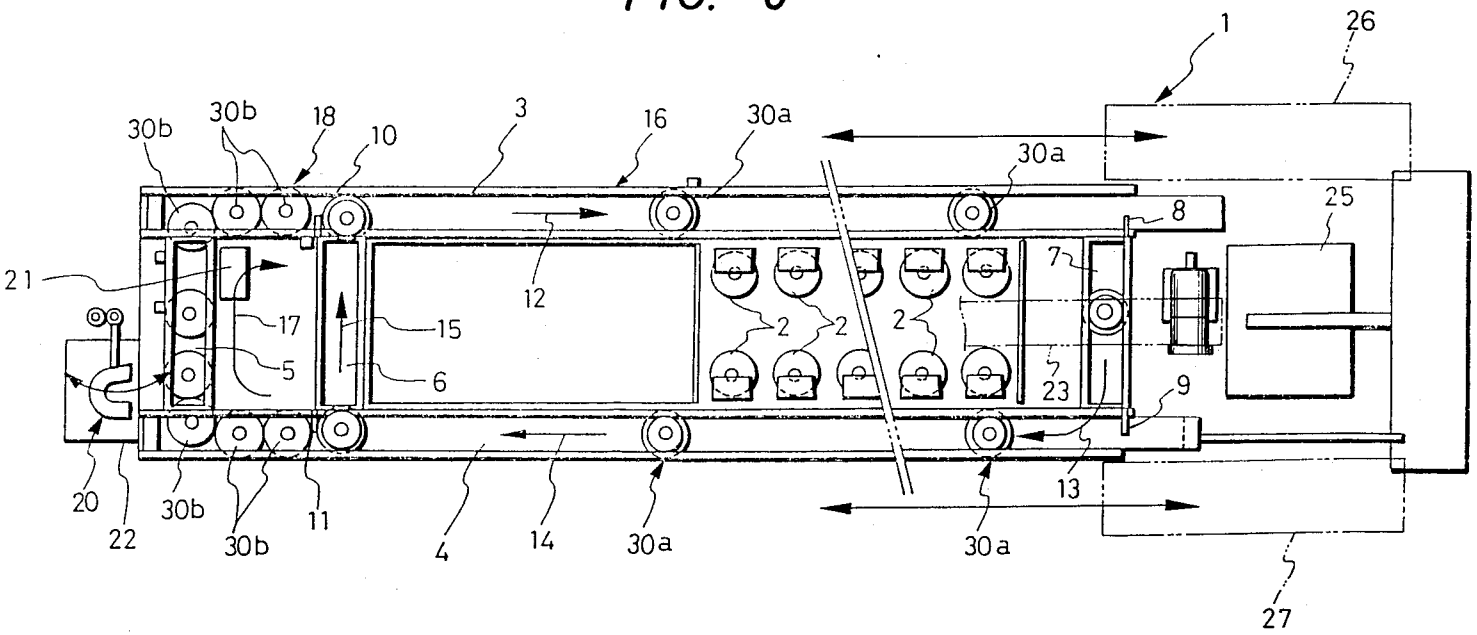
FIG. 8 is a plan view of a yarn twisting machine according to an embodiment of the present invention.
Figure 9:
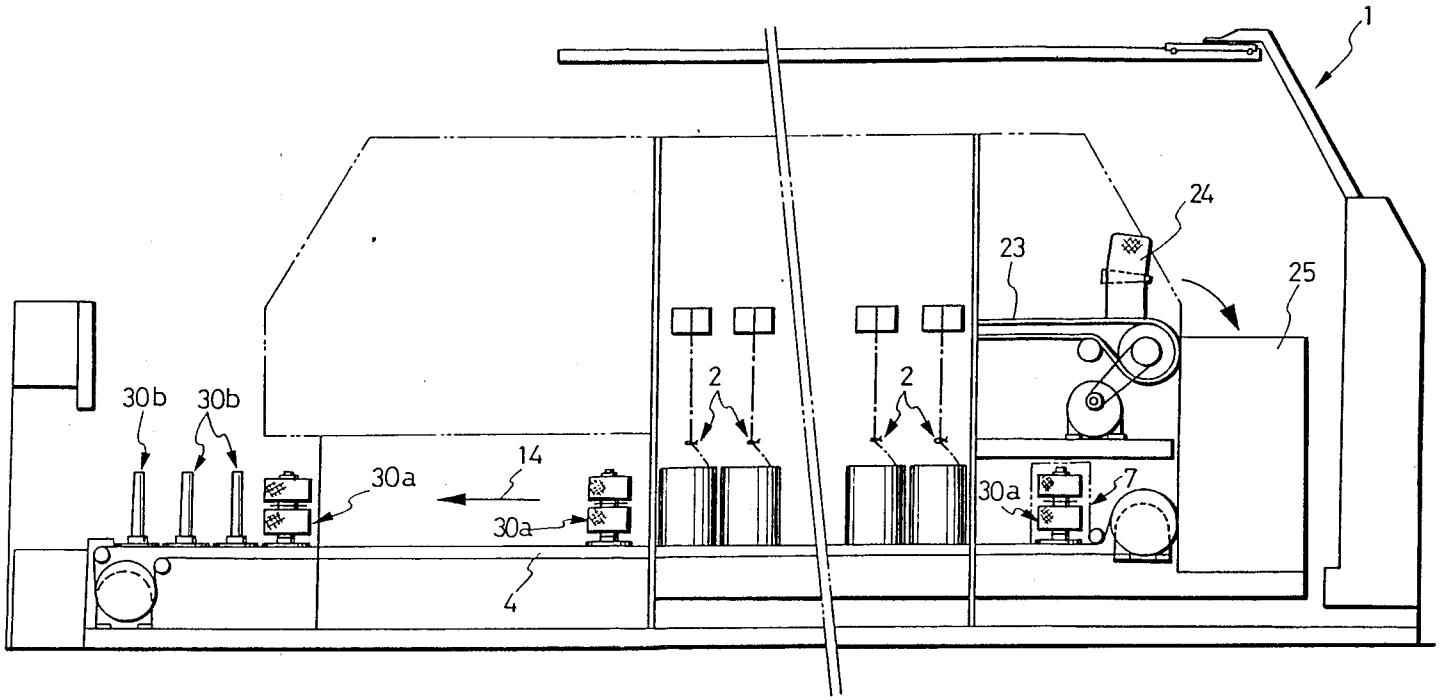
FIG. 9 is a side elevational view of the same yarn twisting machine shown in FIG. 8.

A yarn twisting machine 1 according to an embodiment of the present invention is shown in FIGS. 8 and 9. In the yarn twisting machine 1, a large number of two-for-one twisters 2 of the two stage yarn supply type (hereinafter referred to only as two-for-one twisters) are arranged in a back-to-back relationship in two rows. Long conveyors 3 and 4 extend in two rows on outer sides of the rows of the two-for-one twisters 2 arranged in the back-to-back relationship, and short conveyors 5, 6 and 7 are installed between the long conveyors 3 and 4 at such positions as to bridge the long conveyors 3 and 4. At positions where the long conveyors 3 and 4 and the short conveyor 7 intersect each other, immovable stoppers 8 and 9 are located while movable stoppers 10 and 11 are located similarly at positions where the long conveyors 3 and 4 and the short conveyor 6 intersect each other. The movable stoppers 10 and 11 alternatively assume two positions including a position in which they extend above the long conveyors 3 and 4 and another position in which they are retracted from the long conveyors 3 and 4. The movable stoppers 10 and 11 normally assume the position in which they extend above the long conveyors 3 and 4, thereby forming a circulating line 16 for feeding an article in a direction indicated by arrow marks 12, 13, 14 and 15 and an exchanging line 18 for feeding an article in a direction indicated by an arrow mark 17. Such an article will be hereinafter described in detail. In FIGS. 8 and 9, reference numeral 20 denotes a yarn supply package exchanging device, 21 a yarn end finding device, 22 an empty bobbin receiving box, 23 a transport conveyor for a full wound package 24, 25 a full wound package receiving box, and reference numerals 26 and 27 denote each an automatic package exchanging machine which is reciprocated along the long conveyor 3 or 4.

The article to be fed described above is shown in FIG. 5. The article to be fed is constituted from a transport medium (hereinafter referred to as tray) 30 and yarn supply packages Pa and Pb. The tray 30 includes a projected portion 33 having a conical shape 32 at the top end thereof and provided uprightly at a central portion of a disk member 31. A guide pipe 35 in the form of a pipe having a ring-shaped pawl member 34 formed in an integral relationship at a lowermost end thereof is inserted in and placed on the projected portion 33, and the lower yarn supply package Pb, an annular plate 36 and the upper yarn supply package Pa are inserted in and placed on the guide pipe 35 in this order from below. Reference numerals 37 and 38 denote each a take-up tube of the yarn supply package Pa or Pb. The tray 30 is placed on a belt 39 and travels as the belt 39 travels. Reference numeral 40 denotes a conveyor frame which effects regulation of the position of the tray 30 in upward and downward directions and in leftward and rightward directions.

The tray 30 having such a construction as described above with the yarn supply packages Pa and Pb inserted therein will be referred to as occupied yarn supply tray 30*a* while the tray 30 only with the take-up tubes 37 and 38 inserted therein without having wound yarn thereon will be referred to as empty yarn supply tray 30*b*.

Figure 5:
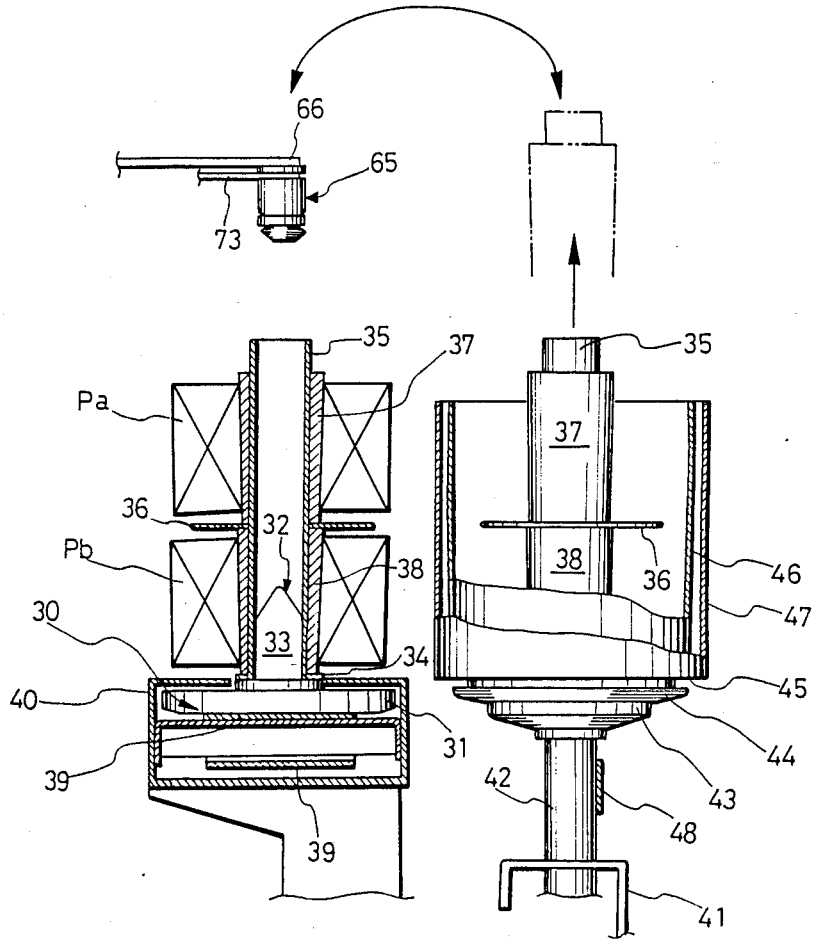
FIG. 5 is a front elevational view showing a yarn supply package on a tray and an empty take-up tube within a two-for-one twister.

In FIG. 5, a two-for-one twister 2 according to an embodiment of the present invention is shown. Now, construction of the two-for-one twister 2 will be described briefly. A delay plate 43 and a rotary disk 44 are secured in an integral relationship to a spindle 42 supported for rotation on a frame 41. Further, a stationary disk 45 is supported on the spindle 42 by means of a bearing and maintains its stationary condition by a magnetic attracting action of a magnet not shown. A package cover 46 is securely mounted on the stationary disk 45.

Meanwhile, a central tubular portion is securely mounted in an integral relationship on the stationary disk 45, and a guide for the guide pipe 35 is inserted in the central tubular portion. Reference numeral 47 denotes a balloon guide, and 48 a belt.

In FIG. 8, an occupied yarn supply tray 30*a* is circulating along the circulating line 16, and it is compulsorily stopped in front of a two-for-one twister 2 which has issued a request for yarn supply packages Pa and Pb whereafter the occupied yarn supply packages carried on the tray 30*a* are exchanged there for the empty yarn supply packages at the two-for-one twister 2 and the empty yarn supply packages are inserted onto the tray 30 by the automatic package exchanging machines 26 and 27. The empty yarn supply tray 30*b* goes out of the circulating line 16 and enters the exchanging line 18. On the exchanging line 18, the empty yarn supply packages are exchanged for occupied yarn supply packages by the yarn supply exchanging device 20, and then ends of yarn on the yarn supply packages Pa and Pb are wrapped around an upper end of the guide pipe 35 by the yarn end finding device 21 as hereinafter described in detail whereafter the tray is returned as an occupied yarn supply tray 30*a* to the circulating line 16 again. A lower yarn supply package Pb and an upper yarn supply package Pa are alternately supplied to the yarn supply exchanging device 20, and upper and lower yarn supply packages are supplied in a discriminated manner. Accordingly, as the exchanging device 20 supplies yarn supply packages Pa and Pb one after another, the lower yarn supply packages Pb are placed on the lower side and the upper yarn supply packages Pa are placed on the upper side.

In particular, in order to eliminate waste of remaining yarn on a lower yarn supply package due to a difference in releasing tension between the upper and lower yarn supply packages, the amount of yarn on the lower yarn supply package Pb is set smaller comparing with that on the upper yarn supply package Pa.

Figure 1:
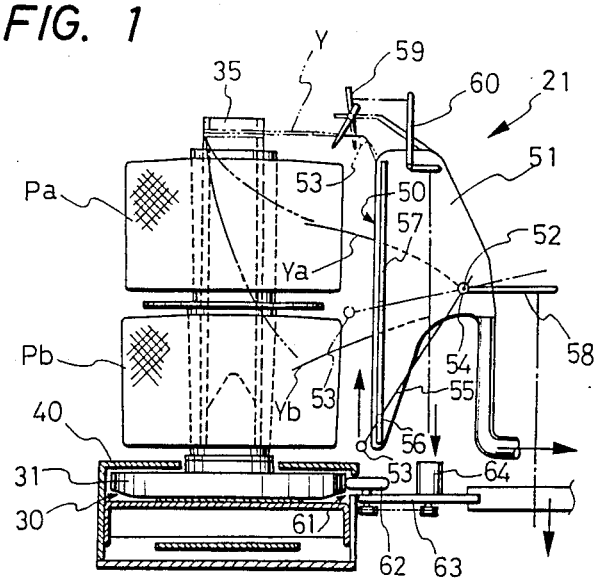
FIG. 1 is a front elevational view showing a yarn end finding device according to an embodiment of the present invention.

Subsequently, construction of the yarn end finding device 21 will be described with reference to FIG. 1 below. A suction pipe 51 opened 50 in the trumpet shape is installed alongside the upper and lower yarn supply packages Pa and Pb. A guide bar 53 is provided for up and down movement around a fulcrum 52 between the opening portion 50 of the suction pipe 51 and the yarn supply packages Pa and Pb. In particular, the guide bar 53 is secured to an end of a link 55 inserted for sliding movement in a shaft 54, and a projected portion 56 between the guide bar 53 and the shaft 54 is fitted for sliding movement in a slot 57. The shaft 54 is connected to a driving member not shown by way of a link 58. Meanwhile, a pair of scissors 59 are installed at the position of an upper end of the suction pipe 51 so that it is enabled to cut yarn Y by a driving device not shown by way of a link 60.

Further, the frame 40 is cut on one side thereof at the position at which the yarn end finding device 21 is installed so that a roller 62 can project into the frame 40 through the cut 61 portion. The roller 62 is supported for rotation on a plate 63 and is connected to a drive motor 64 so that it may be rotated by the latter.

By the yarn end finding device 21 having such a construction as described above, yarn ends Ya and Yb of the yarn supply packages Pa and Pb are sucked into the suction pipe 51 and then the guide bar 53 is lifted. After then, the roller 62 is brought into contact with a side face of the disk member 31 of the tray 30 in order to rotate the roller 62 by several rotations to rotate the tray 30 and the yarn supply packages Pa and Pb. After the yarn ends sucked in the suction pipe 51 have been wrapped lightly in several turns around a top end portion of the guide pipe 35, the yarn Ya and Yb are cut by the scissors 59. It is to be noted that whether the yarn Ya and Yb are sucked in the suction pipe 51 may be detected by detection of presence of yarn by an optical sensor or the like.

Figure 7:
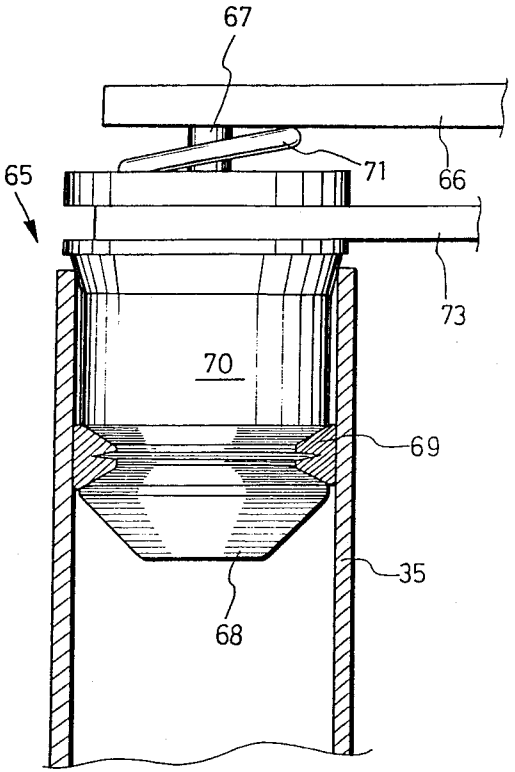
FIG. 7 is a partial longitudinal sectional front elevational view showing a condition upon grasping by the same chuck.
Figure 6:
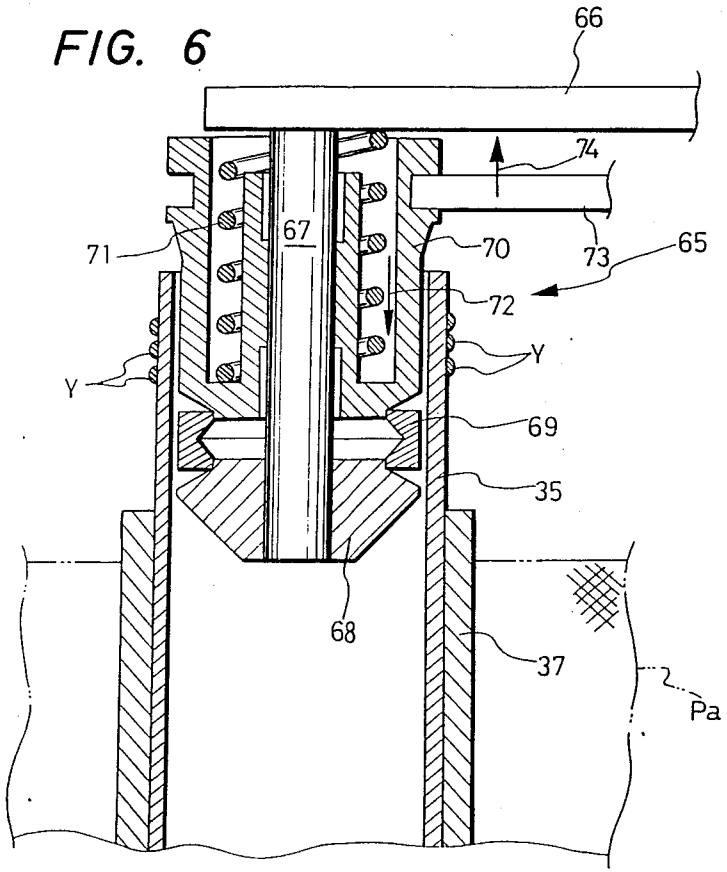
FIG. 6 is a vertical sectional front elevational view showing a chuck of a yarn supply package exchanging device.

FIGS. 6 and 7 show a chuck 65 of the yarn supply package exchanging device 20. The chuck 65 is provided to grasp the guide pipe 35 in which the yarn supply packages Pa and Pb are held inserted and to exchange the occupied yarn supply packages on the tray 30 for the empty yarn supply packages in a two-for-one twister 2. A rod 67 is securely mounted on a base member 66, and a cap 68 is fitted at an end of the rod 67. A deformable annular member 69 formed from an elastic member such as rubber and a slider 70 in the form of a pipe are loosely fitted in this order between the cap 68 and the base member 66. The slider 70 is normally urged in the direction of an arrow mark 72 by a spring 71. Reference numeral 73 denotes a lever secured to the slider 70.

With such a construction as described above, the chuck 65 is inserted into the guide pipe 35 from above in a condition wherein the lever 73 is pulled upwardly 74 against the spring 71. After insertion, if the force of the lever 73 in the upward 74 direction is removed, the slider 70 is moved downwardly by the force of the spring 71 so that the deformable annular member 69 is pressed from the upward and downward directions by the cap 68 and the slider 70. By the pressing force, the deformable annular member 69 is deformed in a circumferentially outward direction to chuck the guide pipe 35 from the inside. Since the inside of the guide pipe 35 is chucked, there is no necessity of taking a surplus length for a portion to be grasped by the chuck at an upper end portion of the guide pipe 35. Accordingly, the overall height of the guide pipe 35 can be reduced. A problem that the overall height is so great that it is apt to cause a trouble in transportation, transfer or the like is inherent to the technical idea that two yarn supply packages are placed one on the other in two stages, and it is a great advantage that the height can be reduced. Moreover, such a construction is provided that an end of yarn is wrapped lightly around an upper end portion of the guide pipe 35 so that no influence may be had on the yarn end upon chucking 65 of the inside.

In the embodiment described above, yarn supply packages are fed to a position near the two-for-one twister while they are placed in two stages, and while they are held in this condition, they are supplied to a two-for-one twister. Accordingly, the labor for supplying yarn supply packages is simplified very much, and at the same time such a trouble that the upper and lower yarn supply packages are inverted when yarn is to be supplied can be eliminated.

In the embodiment described above, the present invention is applied to packages to be supplied to a two-for-one twister of the two stage yarn supply type, and ends of two yarns of two yarn supply packages are wrapped in a lump around the guide pipe. The two packages fitted on the guide pipe are supplied to a two-for-one twister while they are held in the set condition, and processing of two yarn ends is made at a time for the two and is efficient.

It is to be noted that the "yarn end non-existing portion" at an upper end of a yarn supply package may otherwise be a portion of a take-up tube or an upper end portion of a guide pipe inserted in a yarn supply package described above.

In the embodiment mentioned above, packages are carried by a feeding device which comprises a transport medium 30 having a projected portion 33 at a central portion of a plate-formed member and adapted to be fed on a conveyor, and a guide pipe 35 in the form of a pipe adapted to be inserted into the projected portion of the transport medium, whereby a plurality of yarn supply packages are mounted on the guide pipe and fed to a two-for-one twister.

Yarn supply packages are set in a two stage series condition on the guide pipe and transported to the two-for-one twister, and they are supplied to the two-for-one twister while they are held in the set condition.

Figure 2:
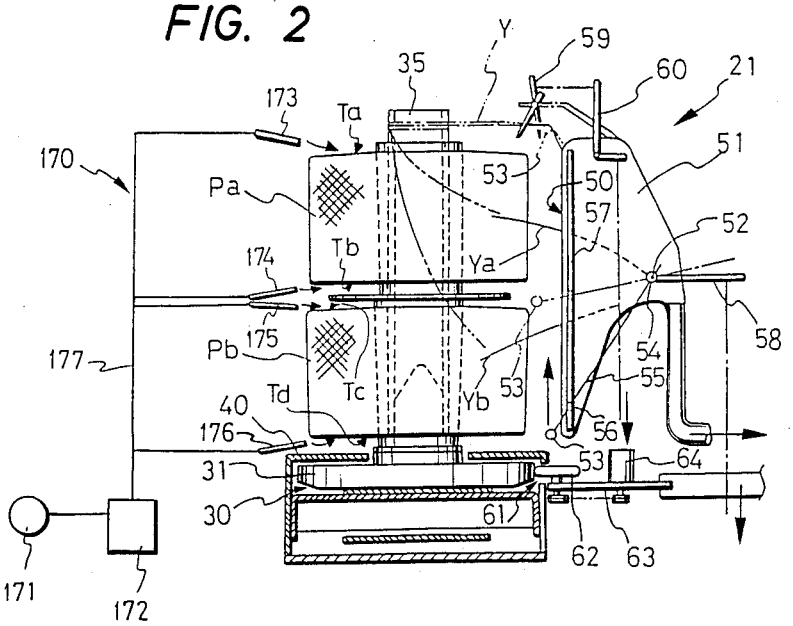
FIG. 2 is a front elevational view showing another embodiment of the present invention, providing an oiling device.
Figure 3:
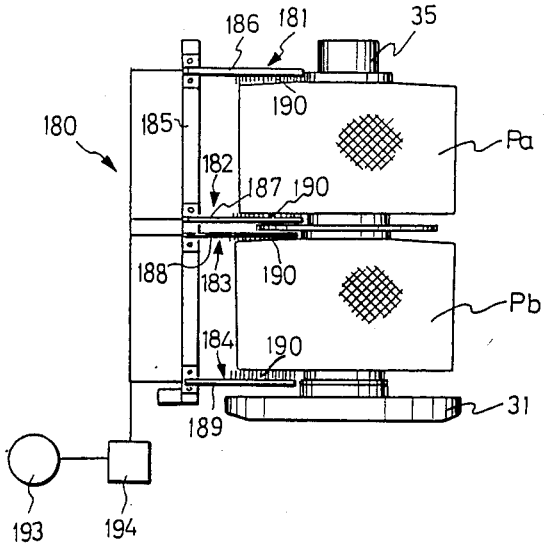
FIG. 3 is a front elevational view showing a still another embodiment of the present invention.
Figure 4:
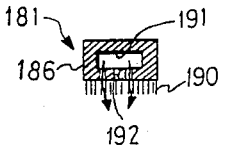
FIG. 4 is a sectional view of a hair member in FIG. 3.

As apparent from the foregoing description, an operation for supplying yarn supply packages to a two-for-one twister of the two stage yarn supply type, that is, an operation for exchanging empty take-up tube for yarn supply packages, can be performed readily, and even when an upper yarn supply package and a lower yarn supply package are supplied as packages of different types, the packages of the different types will not exist in a mixed condition and can be supplied with accuracy. Another embodiment of the present invention is shown in FIGS. 2 to 4 and is illustrated in the following description. The same members as those shown in FIG. 1 are designated in the same numbers and details thereof should be referred to the above instances.

An oiling device 170 is installed at a position opposing to the yarn end finding device 21. The oiling device 170 is constituted from a compressed air source 171, a known oiler 172 and four oil spouting nozzles 173, 174, 175 and 176, and those members are interconnected by a pipe conduit 177. The individual nozzles are inclined a little, and the uppermost nozzle 173 spouts therefrom an atomized wetting agent to a top end face Ta of the upper package Pa, the next nozzle 174 spouts an atomized wetting agent to a bottom end face Tb of the upper package Pa, the next nozzle 175 spouts an atomized wetting agent to a top end face Tc of the lower package Pb, and the lowermost nozzle 176 spouts an atomized wetting agent to a bottom end face Td of the lower package Pb. The nozzles 173 and 175 for spouting to the top end faces Ta and Tc are inclined obliquely downwardly from above the top end faces Ta and Tc while the nozzles 174 and 176 for spouting to the bottom end faces Tb and Td are inclined obliquely upwardly from below the bottom end faces Tb and Td. It is to be noted that a wetting liquid such as, for example, water or oil is flowed into the oiler 172 and the oiler 172 atomizes the wetting agent with compressed air from the compressed air source 171.

An oiling device 180 of a still another embodiment of the present invention is shown in FIGS. 3 and 4.

In this embodiment, individual end faces are wetted by brush conditions 181, 182, 183 and 184. In particular, four handles 186, 187, 188 and 189 are securely mounted on a bracket 185, and hear 190 is implanted on one side face of each of the handles. Each of the handles 186, 187, 188 and 189 is made hollow as shown in FIG. 4, and a hole 192 is perforated from the hollow 191 to the hair 190. Reference numeral 193 denotes a compressed air source, and 194 an oiler.

Accordingly, while flowing an atomized wetting liquid out of the holes 192, the wetting liquid is applied uniformly to package end faces by the hair 190.

Such application of the wetting liquid is performed in a parallel relationship during a wrapping operation of an end of yarn around the guide pipe 35. In particular, while a tray 30 is being rotated by contacting driving by a roller 62, a wetting agent is applied to all the end faces of packages.

According to the embodiment mentioned above, the necessity of provision of a device for applying a wetting agent for each of yarn twisting units of a two-for-one twister is eliminated, and since it is sufficient to provide only one common applying device for a plurality of units, it is economical.

As apparent from the foregoing description, according to the present invention, feeding of a yarn supply package is enabled in a condition wherein there is no floating end of yarn, and such a trouble is eliminated that a floating end of yarn is wrapped around some member therearound or floating ends of yarn are released one after another.

What is claimed is:

1. A package feeding method for feeding a yarn package having a first section on which a yarn layer is wound and a second section substantially devoid of the yarn layer, said method comprising the steps of wrapping an end of the yarn wound on the package in a plurality of turns about the second section of the package and transporting the package with the end of the yarn wrapped about the second section of the package.

2. A package feeding method in a yarn twisting machine having a large number of two-for-one twisters which are operable with two stage yarn supply packages, said method comprising the steps of:

supporting packages of the two stage yarn supply package with a transport medium having a projected portion at a central portion of a plate-formed member and a guide pipe in the form of a pipe adapted to fit on said projected portion of said transport medium and support the packages of the two-stage yarn supply package thereon; and conveying the transport medium with a conveyor toward a two-for-one twister.

3. A package feeding method as claimed in claim 2, wherein said step of conveying comprises the step of wrapping plural turns of an end of yarn of the package on a yarn layer non-existing portion at an end of the package.

4. A package feeding method as claimed in claim 3, further comprising the step of applying a wetting liquid to package end faces in a parallel relationship during said step of wrapping of an end of yarn.

5. A yarn supply package feeding system in a yarn twisting machine having a large number of two-for-one twisters, said system being operable with a plurality of yarn supply packages, said system comprising:

a conveyor arranged to convey yarn supply packages to the two-for-one twisters, a transport medium having a plate-shaped member and a projected portion at a central portion of the plate-shaped member said transport medium being adapted to be conveyed by said conveyor, and a guide pipe adapted to fit on said projected portion of said transport medium, said guide pipe being configured to support the plurality of yarn supply packages for conveyance to the two-for-one twisters.

6. A yarn supply package feeding system as claimed in claim 5, wherein said conveyor is arranged adjacent the two-for-one twisters, said yarn supply package feeding system further comprising:

a yarn supply package loading station arranged adjacent said conveyor; and a yarn end finding device for wrapping a yarn end of each yarn supply package at the top end of the guide pipe, said yarn end finding device being arranged adjacent said conveyor between said yarn supply package loading station and the two-for-one twisters.

7. A yarn supply package feeding system as claimed in claim 6, wherein said yarn end finding device comprises a suction pipe opened in a trumpet shape and arranged alongside the upper and lower yarn supply packages, a guide bar provided for up and down movement between the opening portion of the suction pipe and the yarn supply packages, a yarn and cutting member installed at the position of an upper end of the suction pipe, and means for rotating the transport medium.

8. A yarn supply package feeding system as claimed in claim 5, further comprising a yarn supply package exchanging means for grasping the guide pipe having the yarn supply packages supported thereon and for exchanging the occupied yarn supply packages on the transport medium for the empty packages in a two-for-one twister.

9. A yarn supply package feeding system as claimed in claim 8, wherein said yarn supply package exchanging means comprises a chuck which includes a base member, a rod securely mounted on the base member and having a cap at an end thereof, a deformable annular member formed from an elastic member and a slider in the form of a pipe, said annular member and said slider being loosely fitted between the cap and the base member, and a spring urging the slider toward the cap, said chuck being inserted into the guide pipe from above and said deformable annular member being deformed to chuck the guide pipe from the inside thereof.

10. A yarn supply package feeding system as claimed in claim 6, further comprising an oiling device arranged at a position opposing the yarn end finding device and having wetting means for applying a wetting agent to a package.

11. A yarn supply package conveying system for conveying a first and a second yarn package arranged in a two-stage yarn supply package, said system comprising a transporting means for transporting the two-stage yarn supply package and a wetting means for applying a wetting agent to the first and the second yarn package in the course of transportation of the yarn supply package by said transporting means.

12. A yarn supply package conveying system as claimed in claim 11, wherein said wetting means comprises a compressed air source, an oiler and oil spouting nozzles, said oil spouting nozzles being so located that an atomized wetting agent is applied to a top end face and a bottom end face of each of the first and second yarn supply packages.

13. A yarn supply package feeding system as claimed in claim 11, wherein said oiling device comprises a compressed air source, an oiler and brush members, each of which includes a hollow handle having holes perforated from the hollow to communicate the wetting agent to the face of the brush member.

14. A yarn supply package conveying system as claimed in claim 11, wherein said first and second yarn packages each have first and second package faces, and wherein said wetting means comprises:

a wetting agent reservoir for holding a wetting agent;

a first wetting nozzle arranged in communication with said wetting agent and arranged to apply said wetting agent to the first face of the first yarn package;

a second wetting nozzle arranged in communication with said wetting agent and arranged to apply said wetting agent to the second face of the first yarn package;

a third wetting nozzle arranged in communication with said wetting agent and arranged to apply said wetting agent to the first face of the second yarn package; and a fourth wetting nozzle arranged in communication with said wetting agent and arranged to apply said wetting agent to the second face of the second yarn package.

15. A yarn supply package conveying system as claimed in claim 11, wherein said first and second yarn packages each have first and second package faces, and wherein said wetting means comprises:

a wetting agent reservoir for holding a wetting agent;

a first wetting brush arranged in communication with said wetting agent and arranged to apply said wetting agent to the first face of the first yarn package;

a second wetting brush arranged in communication with said wetting agent and arranged to apply said wetting agent to the second face of the first yarn package;

a third wetting brush arranged in communication with said wetting agent and arranged to apply said wetting agent to the first face of the second yarn package; and a fourth wetting brush arranged in communication with said wetting agent and arranged to apply said wetting agent to the second face of the second yarn package.

16. A package conveying device operable on a yarn supply package which is provided with a first package section having a first yarn wound thereabout and a second package section substantially devoid of the first yarn, said package conveying device comprising:

package transfer means for transferring the yarn supply package; and yarn end finding means operatively connected with said package transfer means, for finding the yarn end of the first yarn wound about the yarn supply package transferred by said package transfer means, said yarn end finding means having yarn winding means for winding the found yarn end about the second package section of the yarn supply package.

17. A package conveying device as claimed in claim 16, wherein:

said yarn supply package is further provided with a third package section having a second yarn wound thereabout;

said yarn end finding means further operates for finding the yarn end of the second yarn; and said yarn winding means further operates for winding the found yarn end of the second yarn about the second package section.

18. A package conveying device as claimed in claim 17, wherein:

said package conveying device is further operable with a two-for-one twisting machine; and said package transfer means comprises a transporting means for transporting the yarn supply package to the two-for-one twisting machine.

19. A package conveying device as claimed in claim 17, wherein:

said yarn end finding means comprises a suction means operable to provide a suction force on the yarn supply package for drawing the yarn ends of the first and second yarns out from the yarn supply package; and said winding means comprises a guide means for guiding the yarn ends drawn out by said suction means toward the second package section and rotating means for rotating the yarn supply package.

20. A package conveying device as claimed in claim 19, wherein:

said suction means comprises a suction source and a suction pipe operatively connected with the suction source, said suction pipe having an opening through which the yarn ends of the first and second yarns are drawn during the operation of the suction means; and said guide means comprises a movable arm movable adjacent said suction pipe opening in the direction toward the second section, said means being arranged to abut and move the yarn ends drawn through said suction pipe opening toward the second package section.

21. A package conveying device as claimed in claim 20, further comprising a package wetting means operable for applying a wetting liquid to the first and second yarns wound about the yarn supply package, said package wetting means being arranged to operate on the package being transferred to said package transfer means.

22. A package transferring system for transferring a first package having a first yarn wound thereon and a second package having a second yarn wound thereon, said system comprising:

a substantially cylindrical package support member having first and second sections configured to support the first and second packages, respectively, said package support member having a third section which is offset from the first and second packages upon the first and second packages being supported by the package support member;

yarn end finding means operable for finding an end of the first and second yarns wound about the first and second packages, respectively, while the first and second packages are being supported by said package support member;

yarn end winding means operable for winding the found yarn ends about said third section of said package support member; and conveying means for conveying said package support member following an operation of said yarn end winding means.

23. A package transferring system as claimed in claim 22, further comprising a package wetting device operable on the first and second packages while the packages are supported with said package support member and while said package support member is conveyed by said conveying means.

24. A package transferring system as claimed in claim 22, said system being operable with a two-for-one twisting device, said system further comprising a package transporting means for receiving the first and second packages supported by said package supporting member from said conveying means and for transporting the first and second packages supported by said package supporting member to the two-for-one twisting device.

25. A package transferring system as claimed in claim 24, wherein:

said package support member having an aperture therein;

said package transporting means comprises an insert member shaped to fit within said aperture, said package transporting means further comprises releasable securing means for releasably securing said insert member to the package support member upon said package support member being fitted within said aperture.

26. A package transferring system as claimed in claim 25, wherein said releasable securing means comprises a deformable member shaped to fit within said aperture and deformable to abut said package support member while fitted within said aperture.

27. A package transferring system as claimed in claim 22, wherein said package support member comprises a tube structure having a substantially hollow section adjacent one end thereof, said system further comprising a package transporting means for receiving and transporting the first and second packages supported by said package supporting member from said conveying means, said package transporting means comprising:

a deformable member shaped to be inserted into said substantially hollow section of said package support member and deformable to press against the inside surface of said tube structure upon being inserted into said substantially hollow section;

wherein upon deforming to press against the inside surface of said tube structure, said deformable member secures with said tube structure; and movement means for moving the deformable member and the package support member secured therewith upon said deformable member being secured with said tube structure.

* * * * *